United States Patent [19]

Strand et al.

[11] 4,110,925

[45] Sep. 5, 1978

[54] AUTOMATIC SCROLL SIGN

[75] Inventors: Neal T. Strand, New Richmond, Wis.; Richard J. Esboldt, St. Paul, Minn.

[73] Assignee: Minnesota Mining and Manufacturing Company, St. Paul, Minn.

[21] Appl. No.: 782,027

[22] Filed: Mar. 28, 1977

[51] Int. Cl.[2] ..... G09F 11/00

[52] U.S. Cl. ..... 40/466; 40/471

[58] Field of Search ..... 40/31, 52, 466

[56] References Cited

U.S. PATENT DOCUMENTS

| | | | |
|---|---|---|---|
| 3,334,432 | 8/1967 | Bates et al. | 40/31 |
| 3,510,973 | 5/1970 | Mazzocco | 40/31 |
| 3,961,433 | 6/1976 | D'Cruz | 40/31 |

FOREIGN PATENT DOCUMENTS

| | | | |
|---|---|---|---|
| 154,494 | 9/1949 | Sweden | 40/31 |
| 1,319,771 | 6/1970 | United Kingdom | 40/31 |

*Primary Examiner*—Louis G. Mancene
*Assistant Examiner*—Wenceslao J. Contreras
*Attorney, Agent, or Firm*—Cruzan Alexander; Donald M. Sell; Robert W. Burns

[57] ABSTRACT

A sign cabinet having a scroll movably mounted on rollers for movement past a display opening in the cabinet. A torsion spring acts on one of the rollers to compensate for differences in the rate of movement of the scroll at the two rollers. An electronic control circuit automatically senses the position of the scroll and is actuated by the position information for controlling the operation of the scroll. The modes of operation include: continuously moving back and forth between preselected end points within the scroll; moving back and forth within a predetermined section within the end points, stopping at preselected frames within the section; and, advancing from one frame or section to another.

3 Claims, 6 Drawing Figures

AUTOMATIC SCROLL SIGN

BACKGROUND OF THE INVENTION

1. Field of the Invention

This invention relates to sign structures, illuminated or not, and in particular to a sign cabinet having a scroll which is automatically indexed past the sign face opening.

2. Description of the Prior Art

There are available sign cabinets or display units having a scroll-like sign face. Such structures are used to selectively display a multiplicity of messages, advertisements, etc. Typical scroll-type sign structures advance the scroll from one message to another under the control of an operator. Examples of such structures are shown in U.S. Pat. Nos. 3,614,727 and 3,761,890, respectively issued Oct. 19, 1971, to Fritts and May 25, 1972, to Fritts et al., both of which are assigned to the assignee of the present invention.

U.S. Pat. No. 3,678,282 issued July 18, 1972, to Johnson et al., describes a photocell-controlled circuit which is used for moving a film strip back and forth between the ends of the strip and stopping at frames on the strip. One or two motors drive the film strip through a differential unit. A system of brakes and clutches is used to maintain tension across the film strip. As will be appreciated, this arrangement is relatively complicated and expensive, and, as mentioned, its operation is limited to moving the strip between its endpoints.

Accordingly, it is highly desirable to have a scroll-type sign structure which has the versatility of operating in a variety of modes, yet, is durable, and relatively uncomplicated and inexpensive.

SUMMARY OF THE INVENTION

The invention relates to a sign structure having a display area, illuminated or not, and a scroll which is divided into sections containing one or more frames or image areas and is wound on and extends between a drive roller and take-up roller for moving the frames past the display area. More particularly, the invention relates to an improvement in such sign structures, comprising: a reversible motor adapted for drivingly engaging the drive roller to advance the scroll past the display area in first and second, opposite directions; switching means controlling the direction of rotation of the motor; a motor control relay having a coil and first and second terminals, the first terminal normally connecting a source of electrical current to the motor for rotating the motor, the motor control relay coil being actuatable for simultaneously disconnecting the first terminal from the source to stop the motor and applying the second terminal to the source; motor control means actuated by said scroll for periodically actuating the motor control relay coil to temporarily stop the scroll with a frame at the display area; a normally-open first switch connected between the second terminal of the motor control relay and the switching means, and activated upon the scroll reaching the end of a section for actuating the switching means to reverse the direction of movement of the scroll; and, a normally-closed second switch connected between the motor control means and the electrical source, and manually openable for rendering the motor control means inoperable.

DETAILED DESCRIPTION

Figure 1:
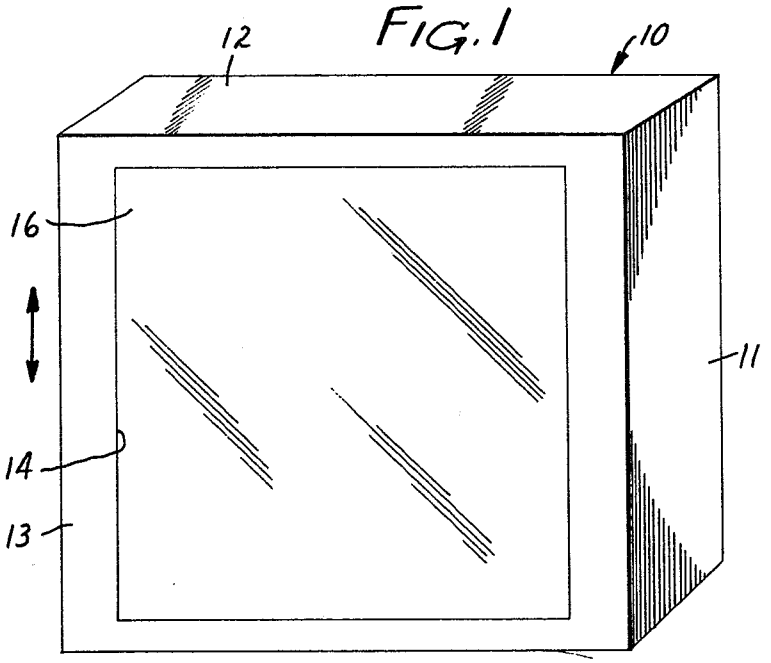
FIG. 1 is a perspective view of a sign structure employing the automatic scroll of the present invention.

FIG. 1 shows a sign cabinet 10 having a scroll 16 which embodies the principles of the present invention. The sign box 10 comprises a rectangular array of opposed side walls 11—11 and end walls 12—12, and sign face 13. Opening 14 in the sign face provides a viewing area for the scroll 16, which is mounted within the sign box 10 for reversible movement in the direction of the arrows. A clear, protective face 17 of glass, acrylic, etc., may be mounted to the sign face 13 to protect the scroll 16.

Figure 3:
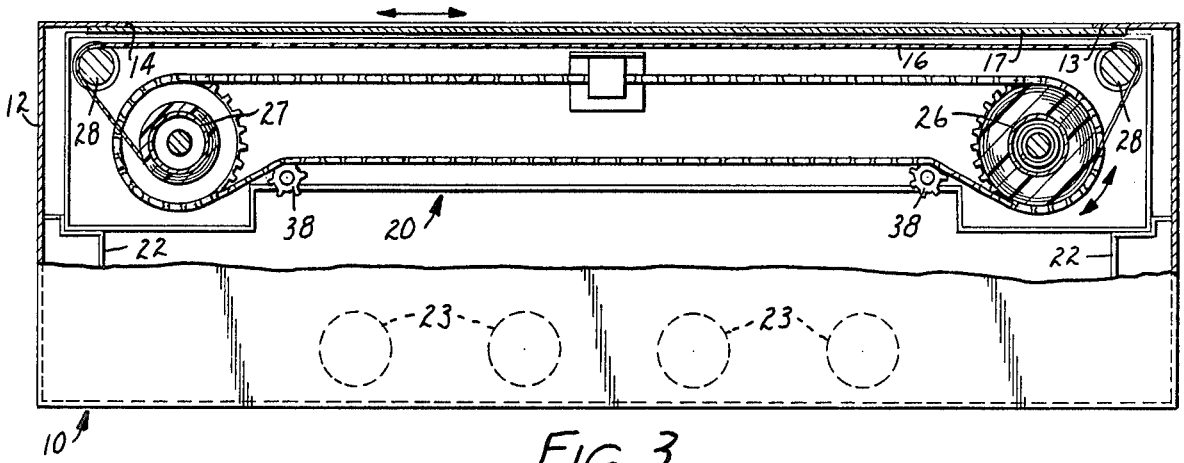
FIG. 3 is a cross-sectional view taken along line 3—3 of FIG. 2.
Figure 2:
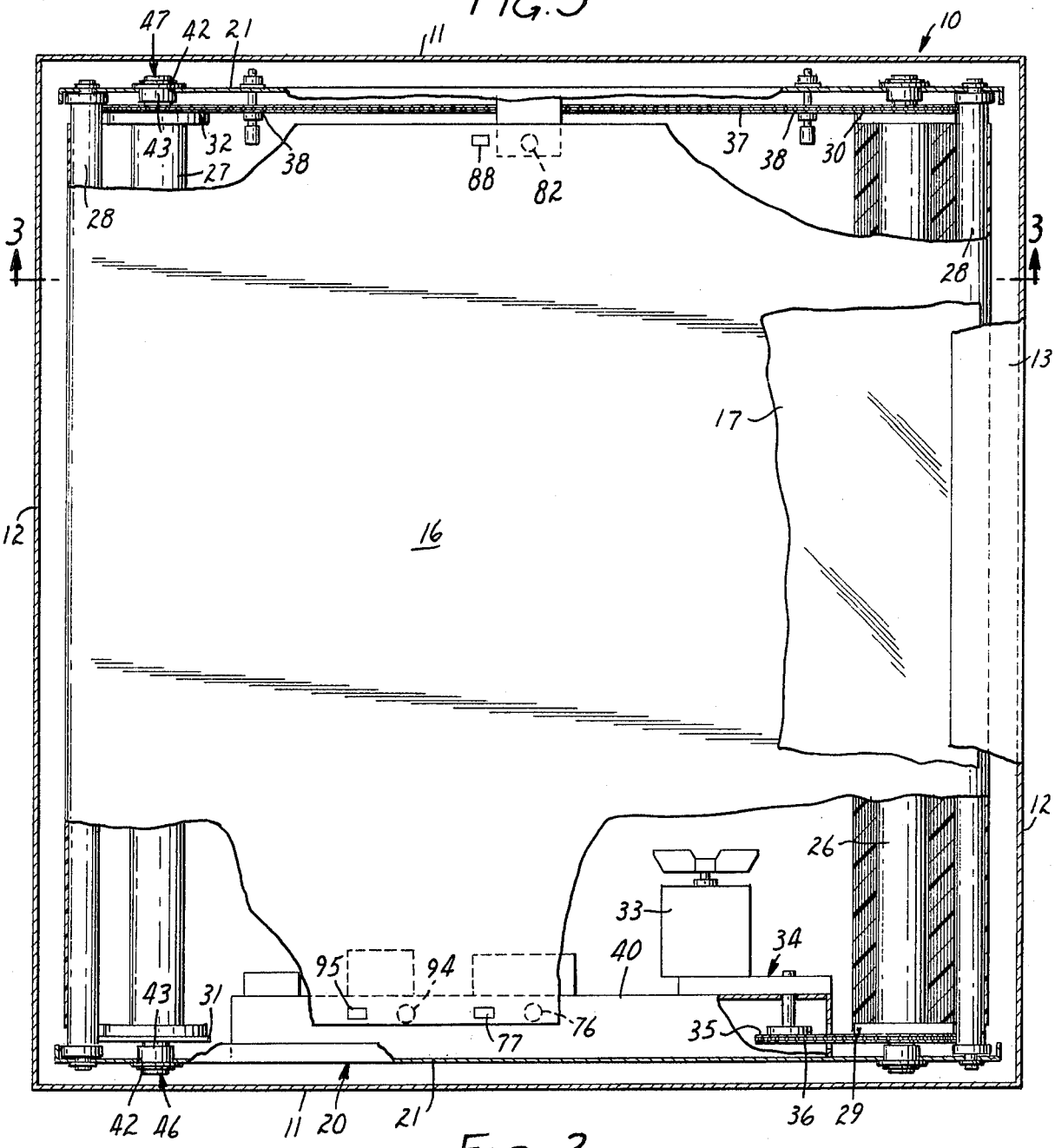
FIG. 2 is a plan view of the sign structure of FIG. 1, taken along a direction looking toward the display area thereof and into the sign structure, and having portions of the front face of the structure and of the scroll cut away for clarity.

Referring to FIG. 2, the mounting and control apparatus for the scroll 16 are mounted to the side walls 21—21 of a frame 20. As shown in FIG. 3, the frame 20 is itself mounted inside the sign cabinet 10 by brackets 22—22 mounted to the sign cabinet walls 11—11 and 12—12. The illustrated sign cabinet 10 is designed to accommodate internal illumination. For example tubular lamps 23—23, shown in dotted outline in FIG. 3, are mounted below the frame 20 for back-lighting the scroll.

Referring again to FIG. 2, opposite ends of the scroll 16 are affixed to a drive roll 26 and a take-up roll 27. The scroll 16 is supported in proximity to the sign face opening 14 (FIG. 3) by idler rolls 28—28 rotatably mounted in parallel in the frame walls 21—21 proximate the opposite end walls 12—12 of the cabinet. The rolls 26 and 27 also are rotatably mounted to the side walls 21—21 of the interior frame 20 in parallel arrangement.

Referring further to FIGS. 2 and 3, and especially to FIG. 2, the drive roll 26 has sprocket wheels 29 and 30 fixedly mounted, respectively, at first and second, opposite ends thereof, while take-up roll 27 has a wheel 31 and a sprocket wheel 32 mounted, respectively, at first and second ends thereof corresponding to the first and second ends of the drive roll. The drive roll 26 is driven by a reversible motor 33 which transmits power through any suitable set of gears 34 and a sprocket wheel 35 to rotate an endless sprocket chain 36 spanning the motor sprocket wheel and the drive roll sprocket wheel 29. As illustrated in FIG. 2, the motor 33 and other components of the control circuit (FIG. 6) can be conveniently mounted in a panel 40 affixed to frame wall 21.

Take-up roll 27 is driven in the same direction as drive roll 26 by an endless sprocket chain 37 which spans the drive roll sprocket wheel 30 and the take-up roll sprocket wheel 32. Two idler wheels 38—38 are journaled to frame side wall 21 and engage the sprocket chain 37 for guiding and maintaining tension in the chain. Rotational movement of the motor 33 in either the clockwise or counter-clockwise direction then moves the scroll to the right or to the left across the sign frame opening 14, as shown by the arrows in FIG. 3.

When the motor drives the drive roll 26 in the counter-clockwise direction, the scroll 16 unwinds from the drive roll 26 and is taken up by the take-up roll 27, and is thereby conveyed to the left (in FIG. 3) past the sign face opening 14. Conversely, when the motor rotates in the clockwise direction, the drive roll 26 is rotated in the clockwise direction, so that the scroll is taken up by the drive roll and unwound from the take-up roll 27 and is thereby advanced to the right past the sign face opening 14.

As will be readily appreciated, as the scroll 16 is transferred from the drive roll 26 to the take-up roll 27 and vice versa, the diameters of the portion of the scroll wound on each roll are constantly changing and, usually, unequal. As a result, the constant rotational speed provided to the two rolls by the sprocket chain 37 actually results in different velocities of movement of the scroll at the two rolls, velocities which are proportional to the diameters of the scroll wound on the rolls. In the absence of some way of compensating for the different velocities, tension is thus not maintained constant across the scroll 16 and the scroll tends either to sag between the rolls 26 and 27 or to bind the rolls.

Figure 4:
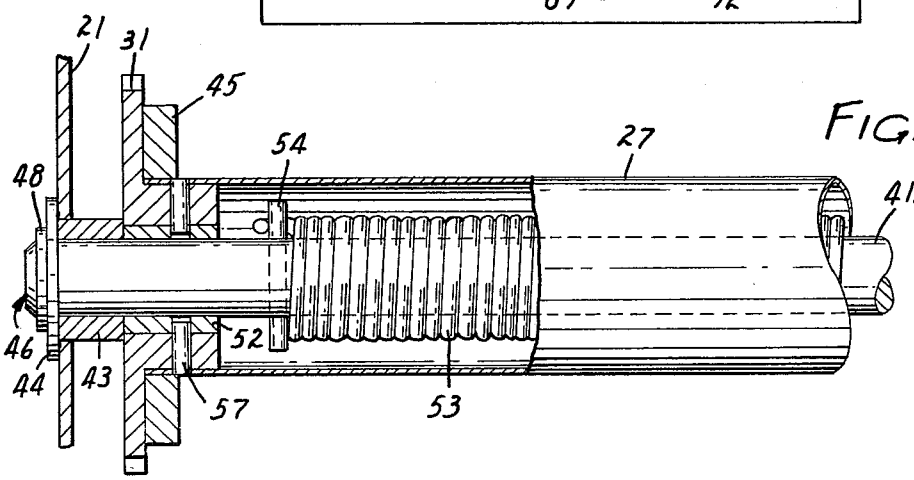
FIG. 4 is a longitudinal cross-sectional view of the take-up roll of the present invention, showing the mounting arrangement for the torsion spring.

According to the present invention, both sagging and bending are prevented by a torsion spring arrangement mounted within the take-up roll 27. As shown in FIG. 4, the take-up roll 27 is mounted between the wheel 31 and the sprocket wheel 32 about a shaft 41, and the shaft-wheel-roll assembly is rotatably journaled to the opposite side walls 21—21 of frame 20 (FIG. 2). That is, the shaft 41 is rotatably mounted to apertures 42—42 in the frame 20 (FIG. 2) within bearings 43—43. Washers 44—44 are retained at opposite ends 46 and 47 of the shaft by split retainer rings 48—48 and journal the assembly and bearings 43—43 between the walls 21—21 so that the assembly rotates within the bearings, yet is secured against sideways movement (i.e., movement parallel to the shaft axis).

At the first end 46 of the shaft 41, the roll 27 is secured to the wheel 31 by pin 57 and the wheel is rotatably mounted on the shaft on bearing 52. At the second or driven end 47 of the shaft 41, the sprocket wheel 32 is secured to the shaft 41 and against bearing 43 by pin 49. Roll 27 is rotatably mounted at the second end 47 of the shaft 41 by bearing 51. A helical torsion spring 53 is wound about the shaft 41 within the roll 27 and has one end thereof affixed to the shaft proximate to the first, non-driven or "free" end 46 by a pin 54. At the second, driven end 47, the spring 53 extends through and is retained in a slot 56 formed in the roll 27. Nylon spacers 45—45 at opposite ends of the take-up roll 27 position the scroll 16 (not shown) on the take-up roll.

The take-up roll 27 would be free to rotate about the shaft 41 but for the connection to the spring 53, and thereby to the shaft 41 and sprocket wheel 32. Because of this interconnection, the rotation of the drive sprocket wheel 32 and the shaft 41 does cause rotation of the roll 27 but, as explained below, at a velocity which is usually different from that of the sprocket wheel 32 and shaft 41. This torsion spring arrangement compensates for the difference in speed of the scroll 16 at the drive roll 26 and take-up roll 27, and maintains nearly constant tension across the scroll.

Figure 5:
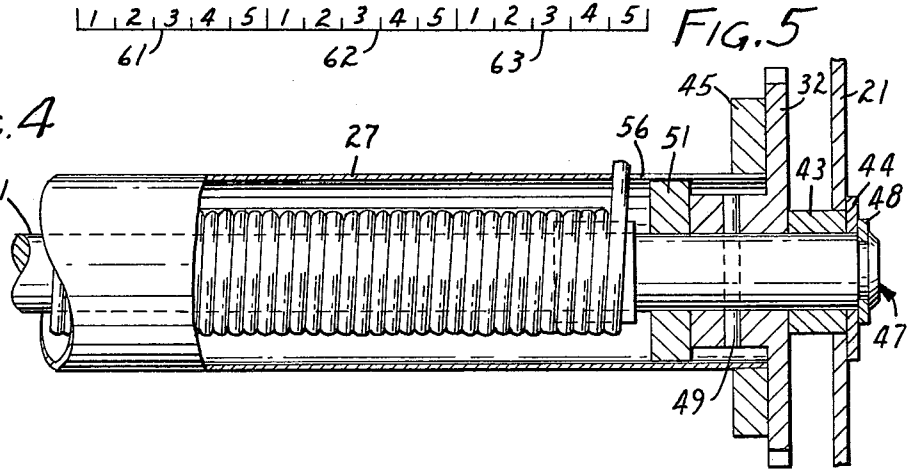
FIG. 5 is a schematic representation of the division of information along the length of the scroll.

Referring to the schematic representation of the scroll 16 shown in FIG. 5, the information on the scroll is divided into a number of sections along the length of the scroll, e.g., sections 61, 62, 63. Each section has a number of discrete frames or image areas in seriatim along the section. Typically, the frames contain advertisements, messages, or other forms of graphic information. As shown for purposes of illustration, each section 61, 62 or 63 contains five frames 1–5.

Before attaching the scroll to the take-up roll 27, the scroll is wound onto the drive roll 26, then the take-up roll is rotated clockwise (FIG. 3) a predetermined number of turns (depending upon how much force is to be applied to the scroll and the characteristics of the spring and also the diameters of the rolls 26 and 27 and the length of the scroll) to wind the spring, then the scroll is threaded around the idler rolls 28—28 and attached to the take-up roll 27.

Then, assuming the scroll 16 is initially fully wound on the drive roll 26 in the sense that the nearest frame to the take-up roll, frame 1 in section 61 (i.e., frame 61-1), is at opening 14, the diameter of the scroll wound on the drive roll (hereafter also termed the "drive roll diameter") is larger than the diameter of the scroll wound on the take-up roll 27 (hereafter also termed the "take-up roll diameter"). As discussed previously, when the motor drives the drive roll 26 in the counter-clockwise direction, the scroll 16 unwinds from the drive roll and is taken up by the take-up roll 27, and is thereby conveyed to the left (in FIG. 3), moving the frames past the sign face opening 14. As the scroll 16 initially unwinds from the drive roll 26 and is taken up by the take-up roll 27, the diameter of the drive roll decreases, while that of the take-up roll increases. Initially, until the roll diameters are equal, the prewound spring unwinds in the counter-clockwise direction, exerting a torque which is complementary in direction to the movement of the take-up roll. The spring 53 thus causes the take-up roll 27 to rotate about the shaft 41 at a faster rate (rpm) than the drive roll 26 and maintains the tension across the scroll and prevents sagging. Once the rolls are of equal diameter and thereafter as the diameter of the take-up roll 26 becomes increasingly larger than that of the drive roll 27, continued counter-clockwise rotation of the take-up roll is against the action of the spring 53 and winds the spring. Here, the rotation of the shaft 41 winds the spring 53, so that the spring slows the movement of the scroll 16 at the take-up roll 27 and thereby prevents binding or lock-up of the rolls.

If the motor rotation is now reversed to the clockwise direction, so that the scroll 16 is taken up by the drive roll 26 and unwound from the take-up roll 27, the operation of the spring 53 remains the same. That is, as the scroll 16 initially transfers from the take-up roll 27 to the smaller drive roll 26, the previously-wound spring unwinds about the shaft to decrease the clockwise rotational speed of the take-up roll 27 and prevent sagging. Then, when the increasing diameter of the drive roll 26 becomes larger than the diameter of the take-up roll 27, continued clockwise rotation of the sprocket wheels 30 and 32 winds the spring 53. Here, the scroll 16 winds the spring 53 about the shaft 41. The spring allows the take-up roll to rotate faster than the drive roll-controlled shaft and thereby to compensate for the relatively small take-up roll diameter and prevent binding. Again, the spring 53 alternately prevents sagging of the scroll 16 between the rolls 26 and 27 and prevents binding of the rolls.

AUTOMATIC MODE OF OPERATION

Figure 6:
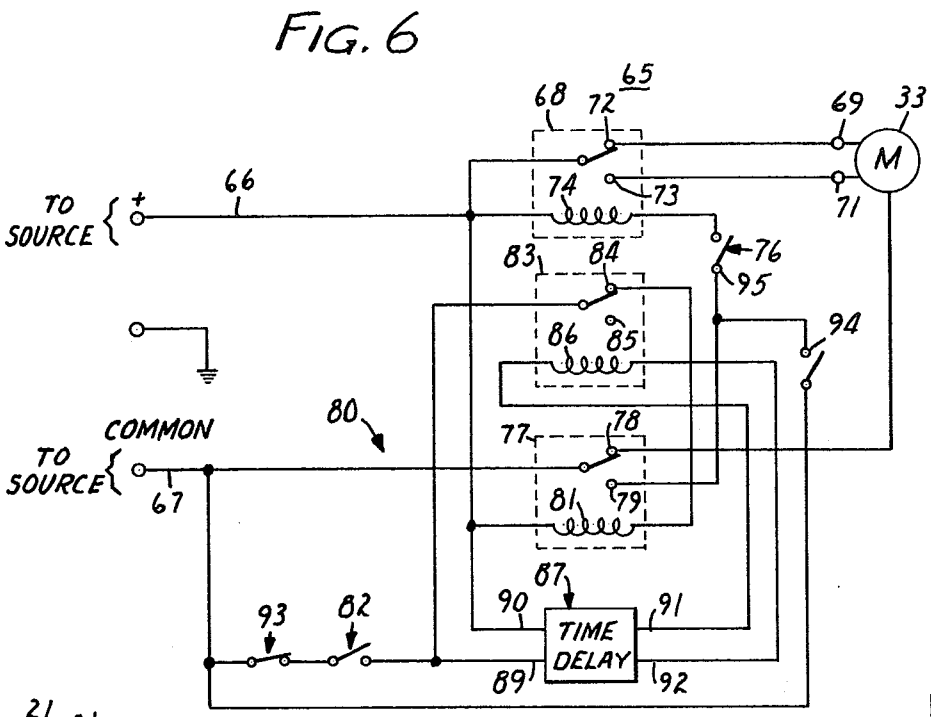
FIG. 6 is a schematic representation of the electric control circuit for the sign structure and scroll.

Referring now to the motor control circuit 65 shown schematically in FIG. 6, power is supplied to operate the motor 33 (FIG. 2) by positive line 66 and common line 67 from a source of electricity (not shown). Typically the lines 66 and 67 are in an electric cord which connects to the outlet of a standard 115 VAC power distribution system or an analogous system.

The direction of rotation of the motor 33 is controlled by a latching relay 68 which applies positive conductor 66 to either of two motor reversing input terminals 69 and 71 via relay terminals 72 and 73. The connection of the positive line 66 to the relay terminals 72 and 73 is controlled by relay coil 74. That is, each time the latching relay coil is pulsed by an electrical signal, the connection is changed from one of terminals 72 or 73 to the other terminal. Application of pulsing signals to the coil 74 is controlled by normally-open switch 76.

The operation of the switch 76 is controlled by the position of the scroll 16 (FIG. 3) relative to the opening 14. That is, switch 76 is a magnetically-controlled, normally open switch which is closed when the magnetic field thereof is broken. Metal tabs 77 (one is shown in FIG. 2) are spaced along one side of the scroll 16 at the opposite ends of each section (only one tab is used between adjacent sections such as 61–62 and 62–63). That is, the tabs 77 are positioned on the scroll 16 so that the tabs pass over the switch 76 when either end frame of a section (e.g., 61-1 or 61-5 in section 1) coincides with the opening 14 of the sign face 13 (FIG. 1). Thus, as the end frame of a section is presented for viewing, the switch 76 (hereafter the "end-of-section" switch) closes and, if the switch is connected to common line 67, applies a pulsing signal to latching relay coil 74 to reverse the movement of the motor 33 and scroll 16. It will be appreciated that this end-of-section switch 76 can be used to keep one section of the scroll moving back and forth past the opening 14.

Operation of the motor 33 and of the end-of-section switch 76 is controlled by relay 77. Terminal 78 of the relay connects to the motor and is normally connected to common line 67, thus completing the circuit necessary to operate the motor. Second terminal 79 of the relay 77 is connected to the end-of-section switch 76. When coil 81 of relay 77 is pulsed, the relay switches the common line 67 from terminal 78 to 79, thereby disconnecting the motor from common and stopping the motor, and also connecting the common line to the end-of-section switch 76 to supply the motor-reversing signal to relay coil 74.

Operation of the relay 77 (hereafter, the "motor control relay") is controlled by a motor operation control circuit 80 comprising another normally open, magnetically-controlled (index) switch 82, relay 83 and time delay relay 87. Index switch 82 is mounted at the opposite side of frame 20 from section reversing end-of-section switch 76. Metal tabs 88 (one tab is shown in FIG. 2) are positioned in each frame 1–5 so that when the frame is positioned coincident with the cabinet opening 14, the index switch 82 closes and applies the common line to input terminals of the relay 83 and the time delay relay 87.

Terminal 84 of relay 83 then applies the common line to the motor control relay coil 81 to stop the motor 33 and apply the common line 67 to end-of-section switch 76, as described previously. This stops the scroll with the image area presented for viewing at the sign face opening 14.

The stopping is temporary, for closure of index switch 82 completes the circuit across the input terminals 89 and 90 of the time delay relay 87. After a predetermined delay, dependent upon the relay characteristics, the time delay relay 87 applies a signal via output terminals 91 and 92 to coil 86, switching the common line from terminal 84 to terminal 85 of relay 83 and thereby removing power from the motor control relay coil 81. As the result, the motor control relay returns to normal, i.e., switches the common line 67 from terminal 79 to terminal 78 to restart the motor 33.

In summary, closure of index switch 82 briefly stops the motor 33 so that each frame stops at the sign face opening 14, then automatically restarts the motor for continued movement of the scroll 16. If the frame is at the end of a section, end-of-section switch 76 is closed and applies a signal to the reversing relay 68 when motor control relay 77 is switched to stop the motor. Consequently, when time delay relay 87 returns relay 77 to normal to restart the motor 33, the direction of rotation of the motor and the movement of the scroll are reversed. A particular section of the scroll 16 is thus automatically moved back and forth past the sign face opening 14, and is stopped for a time to present each of the frames for viewing. Alternatively, by omitting tab 88 at one or more of the intermediate frames, the scroll 16 will automatically cycle back and forth between the section end points moving continuously past the intermediate frames which lack a tab 88.

MANUALLY-CONTROLLED OPERATION

The viewed section of the scroll can be changed or the scroll can be cycled back and forth between its ends using manually-operated, normally closed switch 93. That is, opening switch 93 disconnects the motor operation control circuit 80 from the common line 67, thereby making the circuit inoperable. The motor then (1) advances until the desired frame or section is reached, at which point the switch 93 is again closed to initiate automatic cycling of the scroll within the new section, or (2) cycles the scroll back and forth between the ends of the scroll viewing area (the ends are frames 61-1 and 63-5, FIG. 5).

A magnetically controlled, normally open switch 94 is provided for automatically reversing the movement of the scroll after one of its ends is presented to the viewing opening 14 during manually-controlled operation of the motor. Tabs 95 (one tab 95 is shown in FIG. 2) are located on the scroll 16 at positions suitable for closing the switch 94 at the positions of presentment to the sign face opening 14 of end frame 61-1 and 63-5 (FIG. 5). The closed switch 94 bypasses switch 93 and motor operation control circuit 80 and connects the common line 67 directly to end-of-section switch 76 (on the side thereof connected to terminal 79 of the motor control relay 77). Because the end-of-section switch 76 is also closed (each end of the scroll is also the end of a section), a signal is applied from the common line 67 via switches 94 and 76 to relay coil 74 to reverse the motor.

To summarize and illustrate the manual operation capability, opening switch 93 initiates continuous movement of the scroll back and forth between the ends of the scroll. As long as switch 93 is open, the scroll will continuously cycle back and forth between the viewing area end points 61-1 and 63-5 (FIG. 5).

To illustrate section transfer, assume the scroll is initially cycling within section 62 (FIG. 5) in the automatic mode. If switch 93 is opened as the scroll moves to the right in FIG. 5, the scroll will (1) continue to the right to move section 61 (the section *behind* the initial section 62 in terms of the direction of movement) to the sign face opening 14, then (2) reverse upon the closing of switch 94 and move to the left, presenting sections 61, 62 and 63 in sequence to the sign face opening 14.

Conversely, if the scroll is initially moving to the left within section 62, opening switch 93 causes section 63 to advance to the left for presentment, then reversal of the scroll presents sections 63, 62 and 61 in order. The important thing is that, regardless of the position and direction of movement of the scroll 16, movement of the scroll from the initial section to *any* other section (or from the initial frame to any other frame) is effected by merely opening and closing switch 93.

SUMMARY OF OPERATION

In short, there has been described a scroll sign that will operate in any of three modes: (1) cycling back and forth winin a section of the scroll, momentarily stopping at preselected frames within the section; (2) manually-initiated continuous cycling back and forth between the viewing end points of the scroll; and (3) manually-initiated advancing from one frame or section to another. Combinations of the above modes are of course possible by the placement of the tabs and use of the switch 93.

EXAMPLE

The above modes were demonstrated in an exemplary cabinet 10 having a sign face opening 14 about 19 in. (48 cm.) × 19 in. (48 cm.) and a polyester scroll 16 about 20.5 in. (52 cm.) in width which had a viewing area length of 345 in. (876 cm.). The motor 33 was a reversible, 40 rpm, 20 lb-in torque, 120 VAC model No. 537.82Cl manufactured by ECM Motor Co. of Schaumberg, Ill. The spring was fabricated to specifications (as discussed below) by Midwest Spring, 906 N. Dale, Saint Paul, Minn. and was designed to provide about 51b-in torque. Switches 76, 82 and 94 were No. 5599 Ferrous Metal Proximity Switches by Hamlin, Inc., Lake Mills, Wisc. Latching relay 68 was a Potter Brumfield No. PC5A120; relay 83 was a general purpose relay No. 1330-2C-120A from Guardian Electric Manufacturing Co. of California, Inc., located at 4030 W. Spencer St., Torrance, Calif.; and the time delay relay was No. 0232-1046-6100, also from Guardian Electric Manufacturing Co. of California, Inc.

The scroll comprised three sections, each having five frames. Each frame was about 23 in. (58 cm.) in length, with an information area 19 in. (48 cm.) in length. The motor was able to advance the scroll approximately 15 ft. (457 cm.) per minute using 1.25 in. (3.2 cm.) diameter drive and take-up rolls, which were spaced about 17.4 in. (44.2 cm.) apart.

Preferably, the spring 53 is designed to provide approximately constant torque as it winds and unwinds. For the 1.25 in. (3.2 cm.) diameter rolls 26 and 27, 0.50 in. (1.27 cm.) diameter shaft 41 and the scroll viewing area length of 345 inches or 876 cm. (15 frames × 23 in. or 58 cm./frame), there was a differential of approximately 10 turns or revolutions in the movement of the scroll and the shaft when the scroll advanced from one endpoint thereof to the center, or vice versa. As a result, the spring would wind and unwind about 10 turns during movement of the scroll 16. Also, from experience it was estimated that a spring torque of about 5 lb-in would be sufficient to prevent sagging of the scroll 16 and binding of the rolls 26 and 27. In short, the exemplary spring 53 should be capable of providing an approximately constant 5 lb-in of torque over the 10 turn differential.

The torsion spring 53 was designed to meet the above requirements using:

$$N = (E\,d^4\,T)/10.8\,MD \qquad (1),$$

where $N$ = total number of active coils in the spring,
$E$ = modulus of elasticity,
$d$ = diameter of coil wire,
$T$ = number of turns or revolutions wound into the spring,
$M$ = moment (torque), and
$D$ = mean coil diameter.

The torque characteristics of torsion springs are linear. That is, the torque available from the spring increases/decreases approximately linearly as the spring is wound/unwound. For a given maximum torque, the slope of the linear torque curve (the rate of change of torque) can be decreased by increasing the total number of turns, N, in the spring 53. N can be increased by increasing the number of turns, T, the spring can be wound. Thus, a 5 lb-in spring for which $T = 20$ will experience a relatively large change in torque in winding/unwinding 10 turns (e.g., between 10 and 20 turns). A 5 lb-in spring for which $T = 100$ will experience a lesser change in torque in winding/unwinding 10 turns (e.g., between 90 and 100 turns).

For the arrangement shown in FIG. 4, the maximum length of the wound spring, $l_m$ is limited to the distance between the restraining pin 54 and slot 56. In the exemplary sign cabinet 10, this distance is 19.5 in. (49.5 cm.). Also, the length of the wound spring is given by $l = Nd$, where $N$ is again the number of turns in the spring and $d$ is the thickness or diameter of the spring material. For a spring of given E, $d$, M, and D, changes in torque can therefore be decreased (minimized) by applying various values of T to formula (1) to obtain a relatively large (the largest) value of N for which the length $l = Nd$ is no greater than $l_m$.

In the exemplary embodiment, spring steel wire 0.05 in. (0.13 cm.) in diameter and having a modulus of elasticity, E, of $30 \times 10^6$, was used to form a torsion spring 53 having a mean coil diameter, $d$, of 0.75 in. (1.9 cm.). Using increments of 10 turns (e.g., $T = 10, 20, 30$, etc.) and formula (1), it was determined that $T = 80$ provided the relatively constant torque desired, yet provided 370 active coils ($N = 370$) and a coil length of 18.5 in. (47 cm.), which was less than the maximum possible length, $l_m$, of 19.5 in. (49.5 cm.). $T = 70$ would result in greater changes in torque over the 10 turn differential, while $T = 90$ would result in a spring having approximately 413 turns and a length, $l = 20.6$ in. (52.4 cm.), greater than $l$.

It was found that, when the exemplary spring 53 was prewound a full 80 turns, the take-up roll 27 was difficult to rotate, apparently because the spring tended to bind on the shaft 41. However, the lesser torque (approximately 3.2 lb-in) provided when the exemplary spring 53 was prewound 30 to 40 turns permitted smooth operation of the scroll 16 and achieved the desired effect of maintaining the scroll taut and preventing binding of the rolls 26 and 27. This suggests that the versatility of the torsion spring arrangement could be fully utilized by designing the spring 53 to have a relatively large torque and a large number or the maximum number of coils, then varying the number of turns the spring is prewound to obtain optimum performance.

Thus, there has been described a sign cabinet having a spring-biased scroll which operates in a variety of automatic and manually-controlled modes.

Having described a preferred embodiment and alternative embodiments of the invention, and an example of the preferred embodiment, what is claimed is:

1. In a sign structure having a display area, a scroll adapted for moving past the display area to display information thereon at the display area, and a rotatable motor actuated by line and common conductors for moving said scroll, the improvement comprising:

said scroll having at least one section containing information display regions in seriatim along the length of the scroll and being wound on and extending between two rolls;

said rotatable motor being reversible and having first and second input terminals, the direction of rotation thereof being controlled by applying a first conductor selected from the line conductor and the common conductor to one of the first or second input terminals, said motor being adapted for advancing the scroll past said display area in a first direction and in a second direction, opposite to said first direction;

a motor control circuit for applying the line conductor and the common conductor to said motor, comprising, (1) switching means connected to the first conductor and actuated upon application of a signal thereto for switching the first conductor between said first and second input terminals to change the direction of motor rotation, (2) circuit means for selectively applying the second of the line conductor and the common conductor to the motor, comprising, (a) a normally-open first switch, adapted for closing upon a scroll display region being at the sign structure display area for connecting said circuit means to the second conductor, (b) a first relay having a coil and first and second terminals, said first terminal connecting said second conductor to the motor for advancing the scroll when the coil is inactuated, said coil being actuable for disconnecting the first terminal from said second conductor and connecting the second terminal to the said second conductor, (c) a second relay connecting the second conductor to said first relay coil upon closure of said normally open first switch for actuating said first relay to connect the second terminal thereof to said second conductor, and having a coil for actuating said second relay to disconnect said second relay from said second conductor, and (d) time delay means actuated by the closing of the said normally-open first switch for applying a delayed signal to actuate the coil of said second relay to disconnect said second relay from said second conductor, thereby deactuating said first relay coil to connect said first terminal thereof to said second conductor, (3) a normally-open second switch connected between said switching means and the second terminal of said first relay and closing concurrently with said first switch at the end of the scroll section for actuating said switching means, (4) a normally-open third switch, said third switch closing concurrently with said normally-open second switch at the end of the image areas at either end of the scroll for bypassing the circuit means and connecting said normally-open second switch directly to said second conductor, thereby to actuate said switching means for reversing said motor and (5) a manually operable, normally closed fourth switch connected to said second conductor between said first switch and said third switch for overriding said first switch and said circuit means.

2. The sign structure of claim 1 further comprising spring biasing means attached to one of said rollers to provide a torque of about 3.2 lbs. per inch upon said roller during its rotation to maintain the scroll taut between said rollers and to prevent binding of the scroll with said rolls.

3. In a sign structure having a display area, a scroll and a plurality of discrete sections disposed along the length of the scroll, each section having opposed section ends and within said ends a plurality of frames arranged in seriatim along said section, each frame containing an image area, the scroll further having a series of electrically conductive means positioned in registry with said frames and all or selected section ends, said scroll being rotatably supported by spaced apart drive and take-up rollers to position selected image areas in the display area, the improvement comprising:

(a) a reversible rotatable motor adapted to be electrically energized for driving said drive roller and scroll in first and second directions;

(b) first circuit means for sequentially displaying said images in a first selected section by sensing the conducting means in registry with said frames in said selected section for actuating timing and first switching means to de-energize said motor and stopping movement of the scroll for predetermined intervals to display an image in said display area during the interval and subsequent to the interval energizing said motor for movement of the scroll to the conducting means in registry with an adjacent frame;

(c) second circuit means adapted to sense the connecting means of one of the opposed section ends of the first selected section for actuating second switching means to reverse the rotation of said motor from a first direction to said second and opposite direction and upon reversal thereof interconnecting with said first circuit means to energize said motor and moving said scroll for sequentially displaying said images at the display area at predetermined intervals in said second direction until the conducting means at the opposite end of said section is sensed by the second circuit means;

(d) third circuit means adapted to momentarily disconnect said first circuit and second circuit means to provide continuous energy to said motor and thereby continuously move said scroll in relation to the display area from said first selected section to a second selected section and reconnecting said first and second circuits when said second selected section is in registry with the display area to operate the motor and scroll to sequentially display the frames in said second selected section; and (e) spring biasing means prewound about 20 to 30 turns about said take-up roller and providing a torque of about 3.2 lbs. per inch upon said roller during its rotation.

* * * * *